US009851169B2

(12) United States Patent
McPherson et al.

(10) Patent No.: US 9,851,169 B2
(45) **Date of Patent: *Dec. 26, 2017**

(54) ARCHERY BOW

(71) Applicant: MCP IP, LLC, Sparta, WI (US)

(72) Inventors: Mathew A. McPherson, Norwalk, WI (US); Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/208,486

(22) Filed: Jul. 12, 2016

(65) Prior Publication Data

US 2016/0320157 A1 Nov. 3, 2016

Related U.S. Application Data

(63) Continuation of application No. 14/299,729, filed on Jun. 9, 2014, now Pat. No. 9,389,040, which is a continuation of application No. 13/720,575, filed on Dec. 19, 2012, now Pat. No. 8,746,220, which is a continuation of application No. 12/700,612, filed on Feb. 4, 2010, now Pat. No. 8,505,526.

(60) Provisional application No. 61/149,972, filed on Feb. 4, 2009.

(51) Int. Cl.

| | |
|---|---|
| ***F41B 5/00*** | (2006.01) |
| ***F41B 5/10*** | (2006.01) |
| ***F41B 5/14*** | (2006.01) |

(52) U.S. Cl.

CPC ..... *F41B 5/10* (2013.01); *F41B 5/105* (2013.01); *F41B 5/14* (2013.01); *F41B 5/1403* (2013.01); *F41B 5/1449* (2013.01)

(58) Field of Classification Search

CPC ..... F41B 5/00; F41B 5/1449; F41B 5/14

See application file for complete search history.

(56) References Cited

U.S. PATENT DOCUMENTS

| | | | |
|---|---|---|---|
| 3,012,552 | A | 12/1961 | Allen |
| 3,486,495 | A | 12/1969 | Allen |
| 3,854,467 | A | 12/1974 | Hofmeister |
| 4,020,819 | A | 5/1977 | Haines |
| 4,074,409 | A | 2/1978 | Smith |
| 4,781,168 | A | 11/1988 | Lester |
| 4,879,987 | A | 11/1989 | Nishioka |
| 5,022,377 | A | 6/1991 | Stevens |
| 5,125,389 | A | 6/1992 | Paff |
| 5,323,756 | A | 6/1994 | Rabska |
| 5,339,790 | A | 8/1994 | Smith |
| 5,370,103 | A | 12/1994 | Desselle |
| 5,495,843 | A | 3/1996 | Larson |

(Continued)

*Primary Examiner* — John Ricci

(57) ABSTRACT

In at least one embodiment, an archery bow comprises a riser supporting a first limb and a second limb. The first limb supports a first rotatable member that defines a first axis of rotation. The second limb supports a second rotatable member that defines a second axis of rotation. The first axis of rotation and the second axis of rotation move with respect to one another as the bow is drawn from a brace condition to a drawn condition. The bow defines a reference plane that includes the first axis of rotation and the second axis of rotation, wherein a distance between a predetermined location on the riser and the reference plane is greater in the brace condition than in the drawn condition.

18 Claims, 8 Drawing Sheets

(56) References Cited

U.S. PATENT DOCUMENTS

| | | | | |
|---|---|---|---|---|
| 5,499,618 | A | 3/1996 | Thompson | |
| 5,832,910 | A | 11/1998 | Wolfrath et al. | |
| 5,853,001 | A | 12/1998 | Vyprachticky | |
| 5,921,227 | A | 7/1999 | Allshouse et al. | |
| 6,298,842 | B1 * | 10/2001 | Sims | F41B 5/1426 124/89 |
| 6,758,205 | B2 * | 7/2004 | Kronfeld | F41B 5/1426 124/89 |
| 7,980,236 | B1 | 7/2011 | Kronengold et al. | |
| 8,020,544 | B2 | 9/2011 | McPherson et al. | |
| 8,505,526 | B1 * | 8/2013 | McPherson | F41B 5/10 124/23.1 |
| 2009/0056688 | A1 | 3/2009 | Marsh et al. | |
| 2009/0107475 | A1 | 4/2009 | Pittman | |

* cited by examiner

ARCHERY BOW

CROSS-REFERENCE TO RELATED APPLICATIONS

This application is a continuation application of U.S. application Ser. No. 14/299,729, filed Jun. 9, 2014, now U.S. Pat. No. 9,389,040, which is a continuation application of U.S. application Ser. No. 13/720,575, filed Dec. 19, 2012, now U.S. Pat. No. 8,746,220, which is a continuation application of U.S. application Ser. No. 12/700,612, filed Feb. 4, 2010, now U.S. Pat. No. 8,505,526, which claims the benefit of U.S. Provisional Application No. 61/149,972, filed Feb. 4, 2009, the entire disclosure of which is hereby incorporated herein by reference.

BACKGROUND

This invention relates to generally to archery bows, and more specifically to designs for compound archery bows.

Compound archery bows typically include a cam or pulley at the end of each limb. Each cam or pulley is configured to rotate around an axle. As the bowstring is drawn, the limbs flex and the axles move. If a hypothetical line were drawn between the axles, the line would typically be oriented vertically. As the bow is drawn from a brace condition to full draw, the line would move in a rearward direction, away from the bow handle and toward the shooter.

There remains a need for further improvement in archery bows, including the ability to store more energy in the drawn condition and to gain further control over a bow's draw force profile.

Bow presses are often used when servicing a bow. There remains a need for bow press designs that are more suitable for use with new bow configurations than previous bow press designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, an archery bow comprises a riser supporting a first limb and a second limb. The first limb supports a first rotatable member that defines a first axis of rotation. The second limb supports a second rotatable member that defines a second axis of rotation. The first axis of rotation and the second axis of rotation move with respect to one another as the bow is drawn from a brace condition to a drawn condition. The bow defines a reference plane that includes the first axis of rotation and the second axis of rotation, wherein a distance between a predetermined location on the riser and the reference plane is greater in the brace condition than in the drawn condition.

In at least one embodiment, an archery bow comprises a riser supporting a first limb and a second limb, each limb comprising an inner surface and an outer surface. The bow further comprises at least one bearing accessory attached to the first limb. The bearing accessory comprises a raised portion extending outward beyond the outer surface of the first limb. Desirably, the raised portion comprises curvature about an axis transverse to said first limb.

In at least one embodiment, a combination comprises an archery bow comprising a bearing accessory and a bow press having a bow engaging member. The bearing accessory has a bearing surface of first predetermined shape, and the bow engaging member has a surface having a second predetermined shape, wherein the second predetermined shape matingly engages the first predetermined shape These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 2:
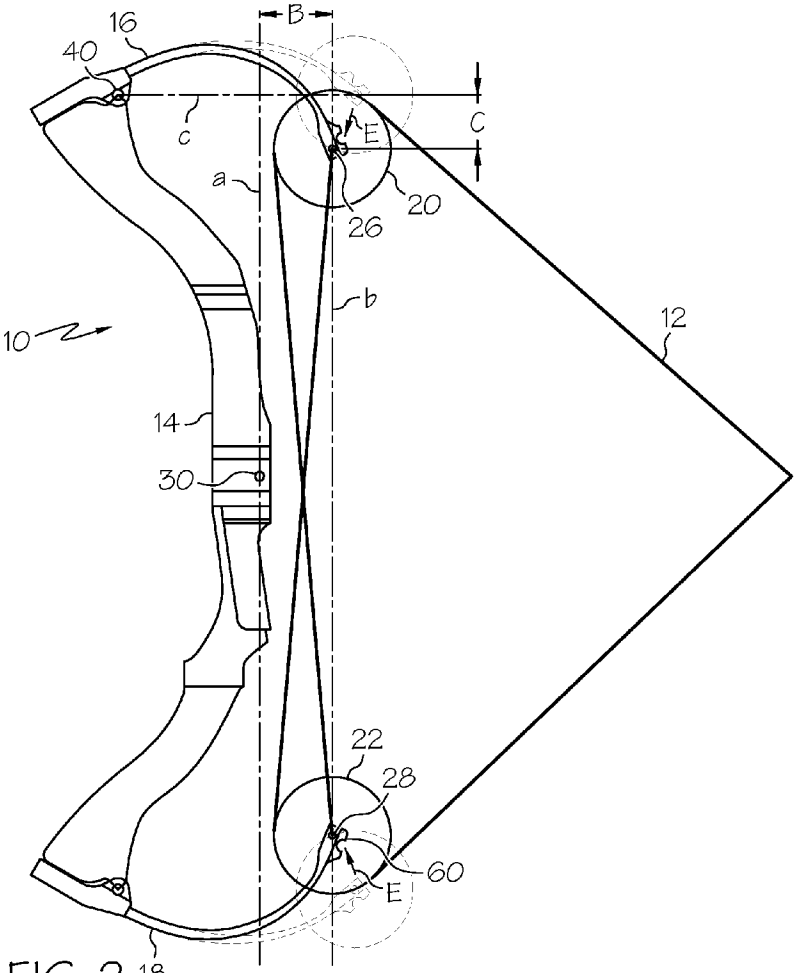
FIGS. 1 and 2 show an embodiment of an archery bow in brace and drawn conditions.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 1:
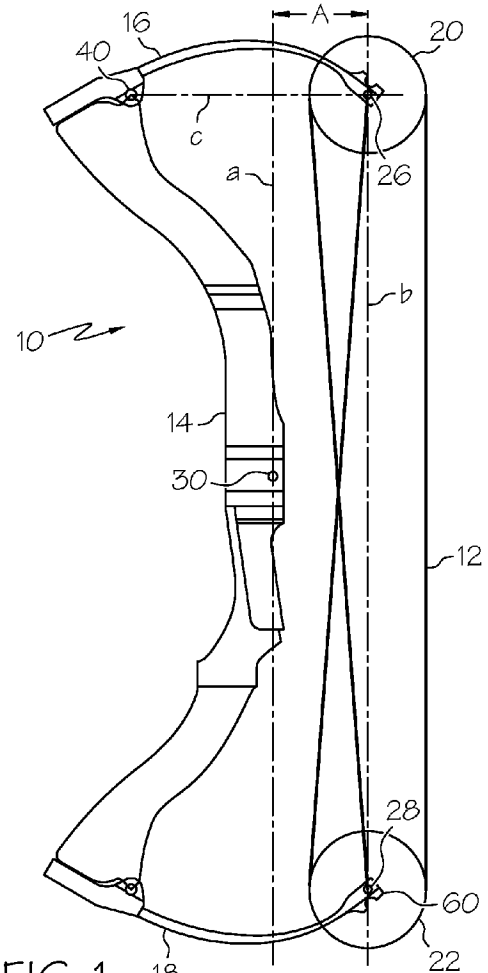

FIGS. 1 and 2 show an embodiment of an archery bow 10. The bow 10 comprises a handle 14, a first limb 16 and a second limb 18. The first limb 16 supports a first axle 26, which in turn supports a first rotatable member 20. The second limb 18 supports a second axle 28, which in turn supports a second rotatable member 22.

FIG. 1 illustrates a brace condition, wherein the bowstring 12 is not drawn. Line b represents a hypothetical line extending between the first axle 26 and second axle 28. Line b also represents a two-dimensional plane extending parallel to a longitudinal axis of each axle 26, 28. Line a represents a reference line oriented parallel to line b and passing through a predetermined location 30 on the handle 14.

In some embodiments, the predetermined location 30 comprises a location from which brace height is measured. For example, in some embodiments, the predetermined location 30 comprises a pivot point 31 of the grip 15. In some embodiments, the predetermined location 30 comprises an accessory mount location, such as an arrow rest mount location.

A distance between line a and line b is illustrated as distance A, for example taken in a direction orthogonal to the lines a, b.

Line c represents a hypothetical line drawn between the first axle 26 and an effective fulcrum 40 of the first limb 16. As the bowstring 12 is drawn, the fulcrum 40 represents an effective support point for the limb 16, which acts as a cantilever. As illustrated, in some embodiments, line c extends orthogonal to line/plane b.

FIG. 2 shows the bow 10 of FIG. 1 in a drawn condition. Each axle 26, 28 has moved with respect to its location in the brace condition. Vectors E are shown, which approximately represent the forces effectively applied to the axles 26, 28 by the cables of the archery bow. Line/plane b has moved in a direction away from the bowstring 12 and toward the handle 14. The distance between line a and line b is illustrated as distance B, for example taken in a direction orthogonal to the lines a, b. The distance B in FIG. 2 is less than distance A in FIG. 1.

In some embodiments, the distance A in the brace condition and distance B in the drawn condition represent the shortest distances between the predetermined location 30 and the line/reference plane b.

In various embodiments of the invention, the configuration of the limbs 16, 18 and locations of the axles 26, 28 in the brace and drawn conditions can be adjusted to allow for desired draw force profiles and movement of line/plane b. Movement of line/plane b in a direction toward the handle 14 can allow more energy to be stored in the bow. The specific movement of line/plane b as the bow is drawn can be used to impact the draw force profile.

In some embodiments, line/plane b can initially move away from the handle 14 then reverse the direction of travel, thus moving back toward the handle. In some embodiments, line/plane b moves past its original location in the brace condition and ends its travel at full draw being located closer to the handle 14.

In some embodiments, line/plane b remains a constant distance or a substantially constant distance from the handle 14 as the bow is drawn from brace to full draw.

In some embodiments, the invention is drawn to a bow wherein the line/plane b moves in a direction toward the handle 14 during some portion of bowstring draw, regardless of whether or not the line/plane b previously moved in a direction away from the handle 14.

Figure 4:
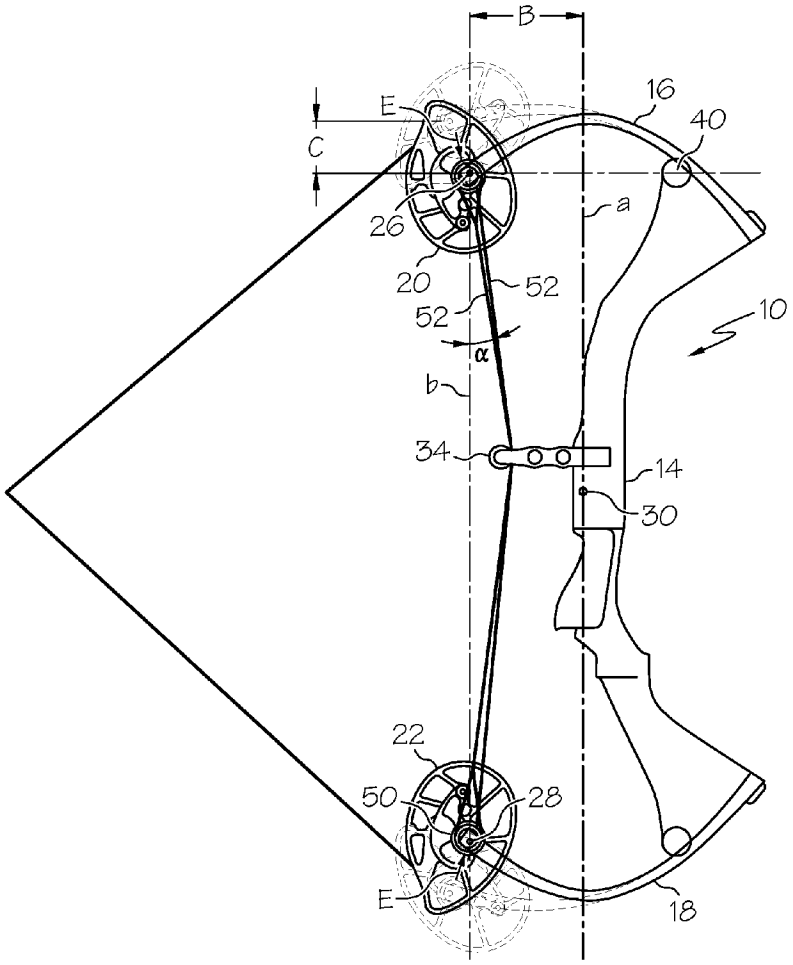
FIGS. 3 and 4 show another embodiment of an archery bow in brace and drawn conditions.
Figure 3:
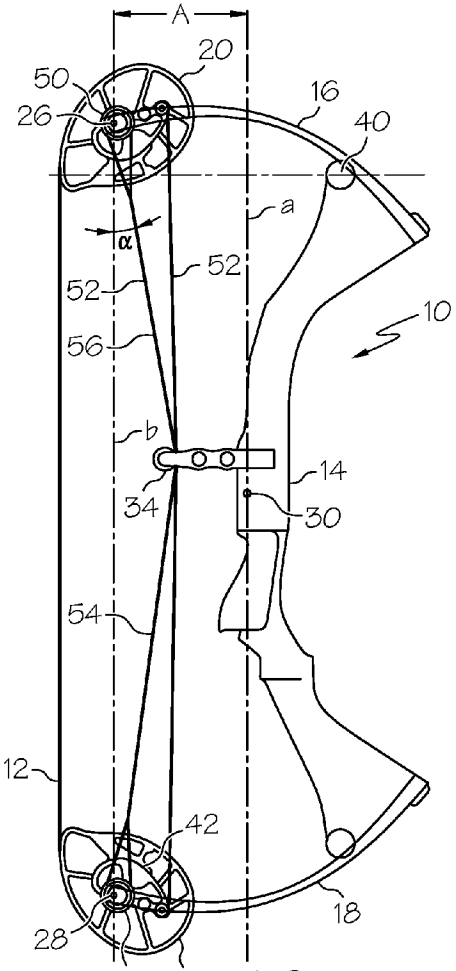

FIG. 3 shows another embodiment of an archery bow 10 in a brace condition, and FIG. 4 shows the bow 10 of FIG. 3 in a drawn condition. The bow 10 includes many components similar to the bow of FIG. 1, as indicated by like reference characters. The bow 10 of FIG. 3 further comprises power cable force vectoring anchors 50, for example as described in U.S. patent application Ser. No. 12/248,467, the entire disclosure of which is incorporated herein by reference in its entirety.

The bow 10 of FIG. 3 also comprises a cable guard 34 that biases a portion of each power cable 52 in a direction toward the handle 14. As shown, the cable guard 34 comprises a roller guard.

Lines a and b, similar to those described with respect to FIG. 1, are shown on FIGS. 3 and 4. As the bow 10 transitions from brace to full draw, line/plane b moves closer to the handle 14. Because line/plane b moves closer to the cable guard 34, the effects of undesirable lateral forces imparted to the bow 10 from the cable guard 34 are reduced when compared to prior art designs.

In some embodiments, line/plane b begins to move toward the handle 14 as the bow is initially drawn, and will continue to move closer to the handle 14 as the bowstring 12 is drawn to full draw.

In some embodiments, a power cable 52 extends from a power cam 42 on one rotatable member (e.g. 22) to an anchor (e.g. 50) on or near the opposite rotatable member (e.g. 20) that does not include a power cam. The power cable 52 can comprise a cam side 54 located between the roller guard 34 and the power cam 42, and an anchor side 56 located between the roller guard 34 and the anchor 50.

Desirably, an angle $\alpha$ between line b (reference plane) and the anchor side 56 of the power cable 52 is less in the drawn condition than in the brace condition.

Referring again to FIGS. 1 and 2, in some embodiments, an archery bow comprises a bearing accessory 60. In general, the bearing accessory 60 comprises a structure that can be engaged by a bow press. A bearing accessory 60 will help a bow press engage a bow in a safe manner.

Figure 5:
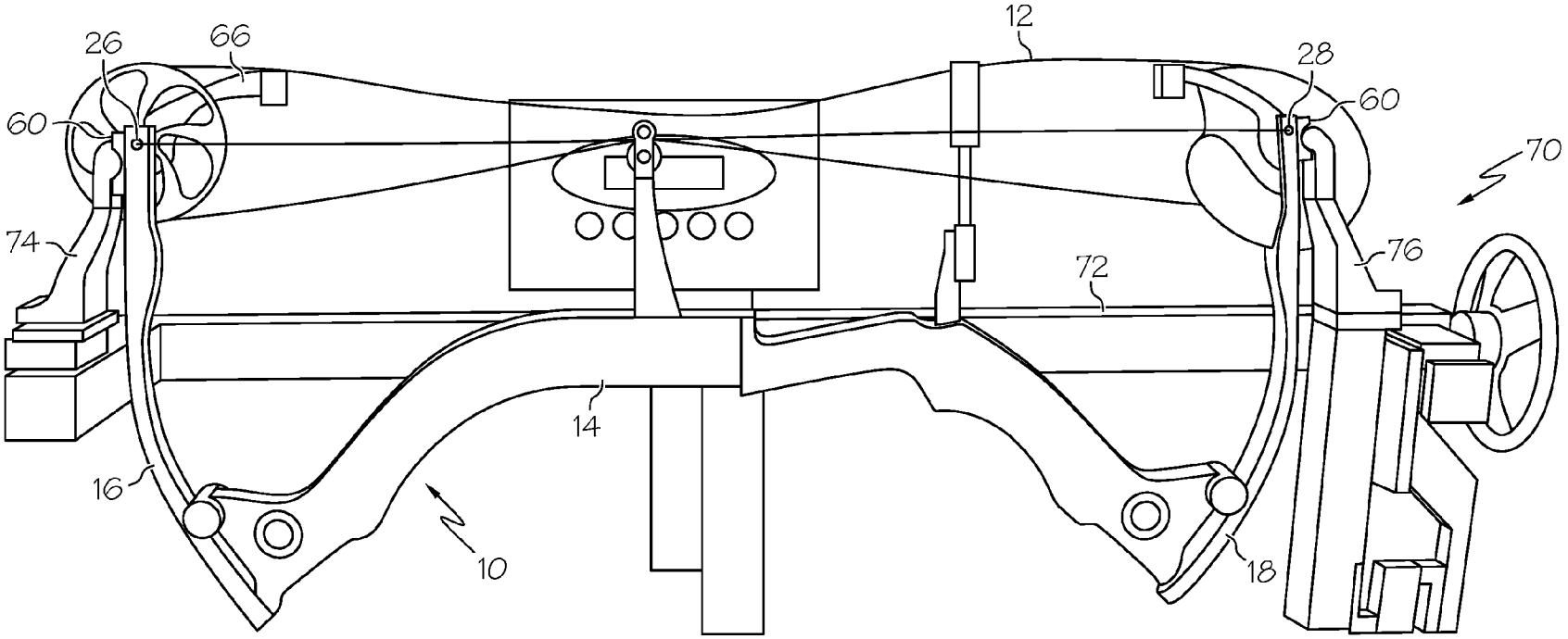
FIG. 5 shows an embodiment of an archery bow and an embodiment of a bow press.
Figure 6:
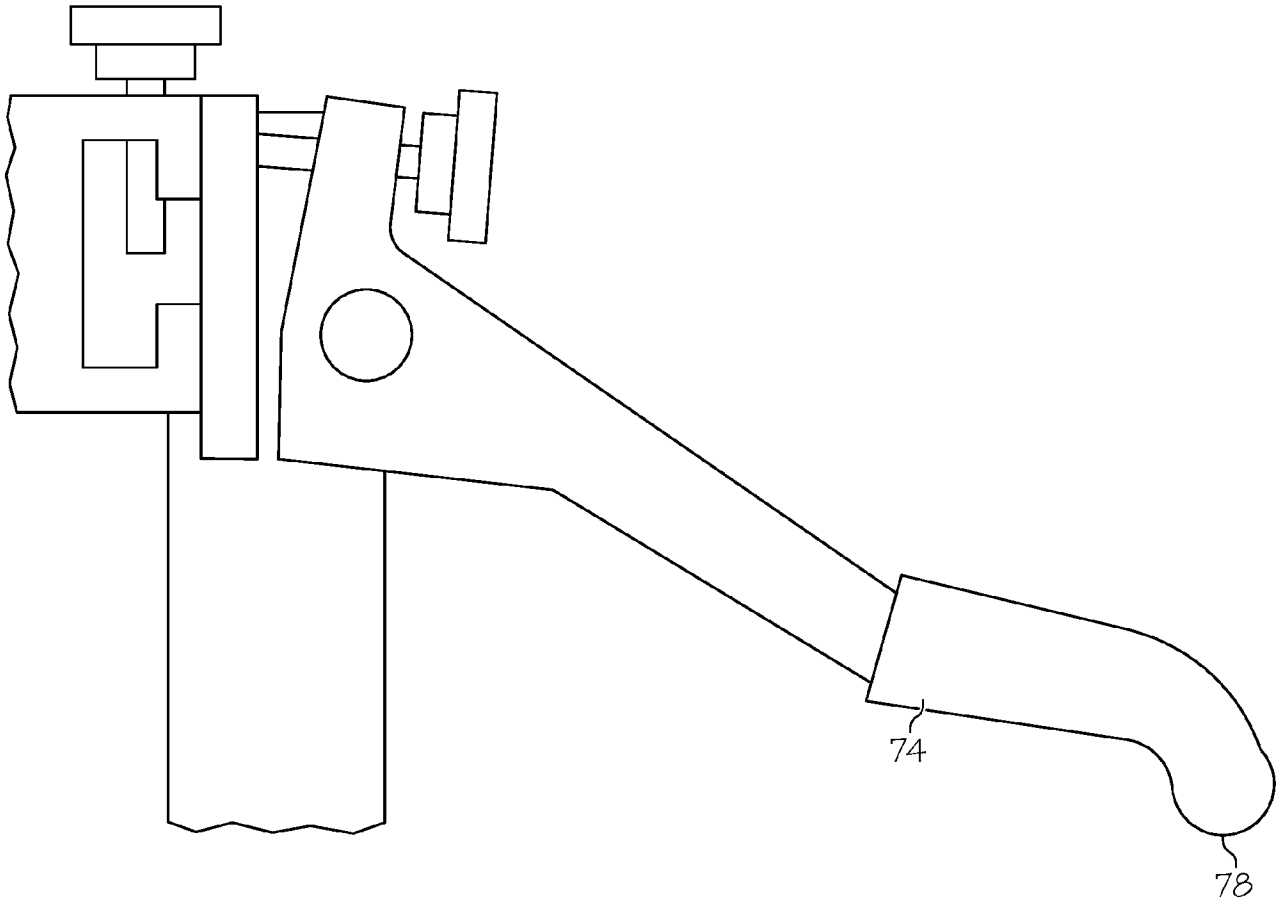
FIG. 6 shows an embodiment of an engaging member of a bow press.

FIG. 5 shows an example of a bow press 70 and an embodiment of an archery bow 10 being engaged by the bow press 70. The bow press 70 generally comprises a body portion 72 that supports a first engagement member 74 and a second engagement member 76. The first engagement member 74 and the second engagement member 76 are moveable with respect to one another—for example, in some embodiments, the second engagement member 76 moves along the length of the body portion 72. The bow press 72 engagement members 74, 76 are generally positioned to abut the limbs 16, 18 of the archery bow 10 and force the limbs 16, 18 and axles 26, 28 towards one another. The resulting slack in the bow cables (e.g. bowstring 12) allows the bow to be serviced safely.

As archery bows have evolved, the positioning of the limbs 16, 18 has changed. Whereas older bows typically had spacing between the limbs 16, 18 that continuously increased as the limbs 16, 18 were traversed from the handle/riser 14 toward the axles 26, 28, the bow 10 shown in FIG. 5 includes limbs 16, 18 that extend parallel or near-parallel to one another from an approximate mid-portion of each limb 16, 18 to the axles 26, 28.

Referring to FIGS. 1 and 2, a bow 10 is shown where the limbs 16, 18 pass through a parallel configuration and even curve back toward one another. See, for example, the portion of the limbs 16, 18 located in the area between line a and line b. As the limb 16, 18 orientation extends "beyond parallel," conventional bow presses in some cases may not be suitable to properly engage the bow.

FIG. 5 shows a bow 10 comprising a bearing accessory 60 on each limb 16, 18, and a bow press 70 having engaging members 74, 76 that are respectively shaped to matingly engage a bearing accessory 60.

Referring to FIGS. 5-8, the bearing accessory 60 comprises a bearing surface 62 configured to receive and engage an engaging member 74. The bearing surface 62 comprises a first predetermined shape. Desirably, the engaging member 74 comprises a surface 78 having a second predetermined shape, wherein the first predetermined shape and the second predetermined shape are constructed and arranged to matingly engage one another. For example, the first predetermined shape and the second predetermined shape can comprise similar curvature. In some embodiments, the bearing surface 62 and the engaging surface 78 comprise semicircular and/or semi-cylindrical shapes.

Figure 7:
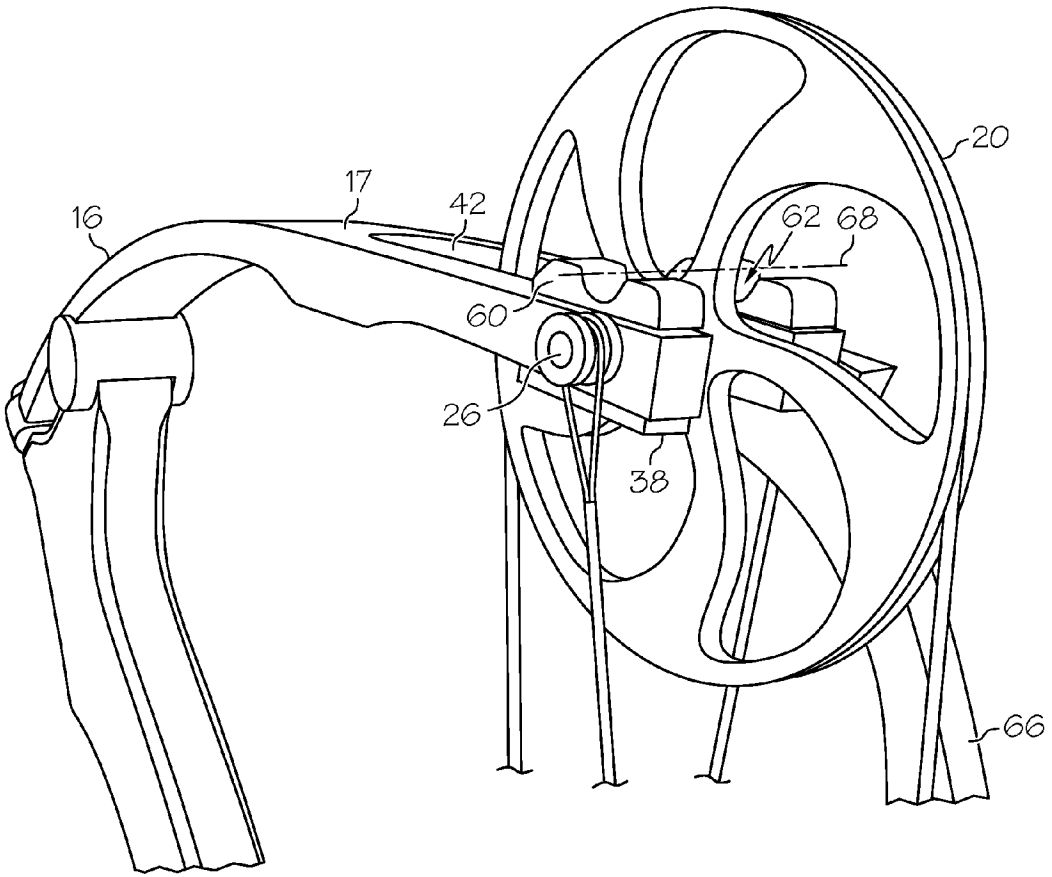
FIG. 7 shows a portion of an archery bow that includes at least one embodiment of a bearing accessory.
Figure 8:
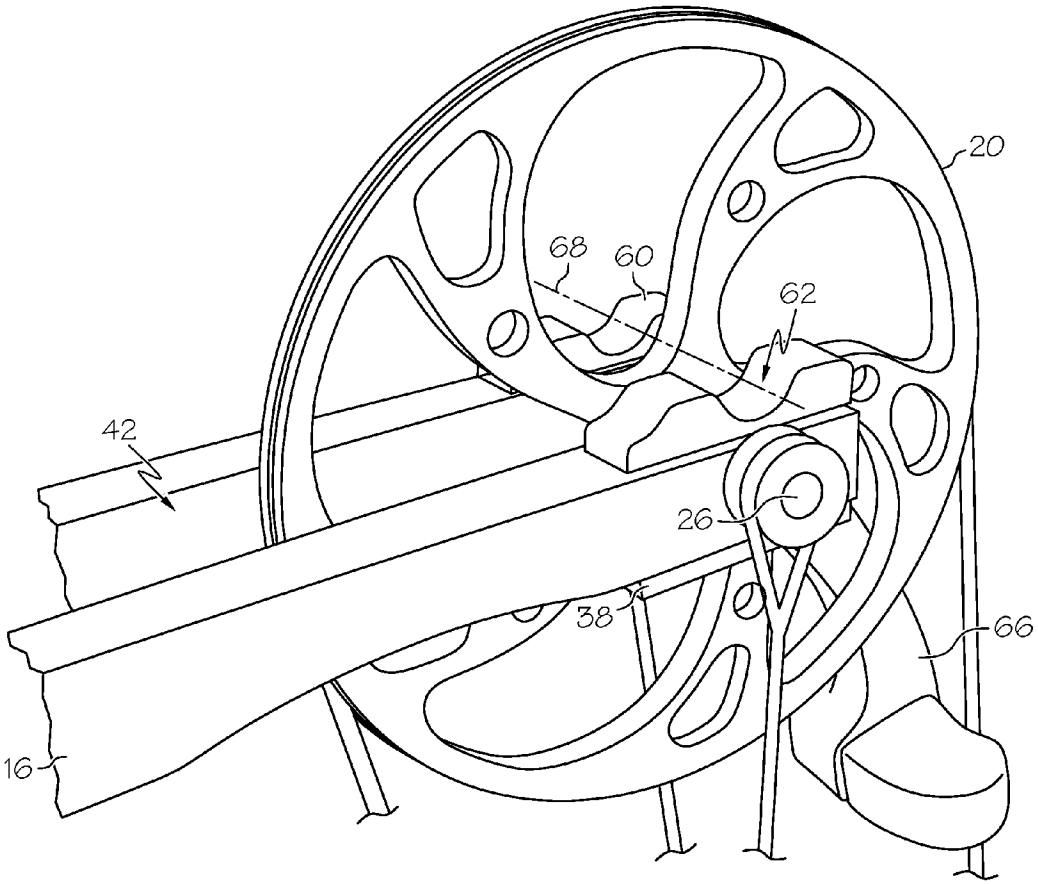
FIG. 8 shows another view of the bow shown in FIG. 7.

FIGS. 7 and 8 show a portion of an archery bow in detail. In some embodiments, a limb 16 comprises a split portion defining a groove 42. A rotatable member 20 can be positioned in the groove 42 and supported on an axle 26 that is supported by the limb 16. Each side of the split limb portion can include a bearing accessory 60.

Desirably, the bearing surface 62 of each bearing accessory 60 comprises a raised portion that extends outward beyond the outer surface 17 of the limb 16. The raised portion provides a flange that the bow press 70 can engage.

The bearing surface 62 can comprise any suitable shape. In some embodiments, at least a portion of the bearing surface 62 extends at an angle to the outer surface 17 of the limb 16. In some embodiments, the bearing surface 62 is not oriented perpendicular to the outer surface 17.

In some embodiments, the bearing surface 62 comprises curvature about an axis 68 oriented transverse to the limb 16. For example, the axis 68 can be parallel to said axle 26. In some embodiments, the curvature is convex with respect to the limb 16.

In some embodiments, the bearing surface 62 is flat in a direction parallel to said axis 68.

The bearing accessory 60 can be attached to the limb 60 using any suitable method, such as adhesives, fasteners or the like.

In some embodiments, the bearing accessory 60 further comprises a target plate 38 that can be used to secure the bearing accessory 60. For example, in some embodiments, the bearing accessory 60 and the target plate 38 are positioned on opposite sides of the limb 16, and fastener such as a bolt can attach the bearing accessory 60 to the target plate 38. In some embodiments, a fastener extends through a portion of the limb.

Figure 9:
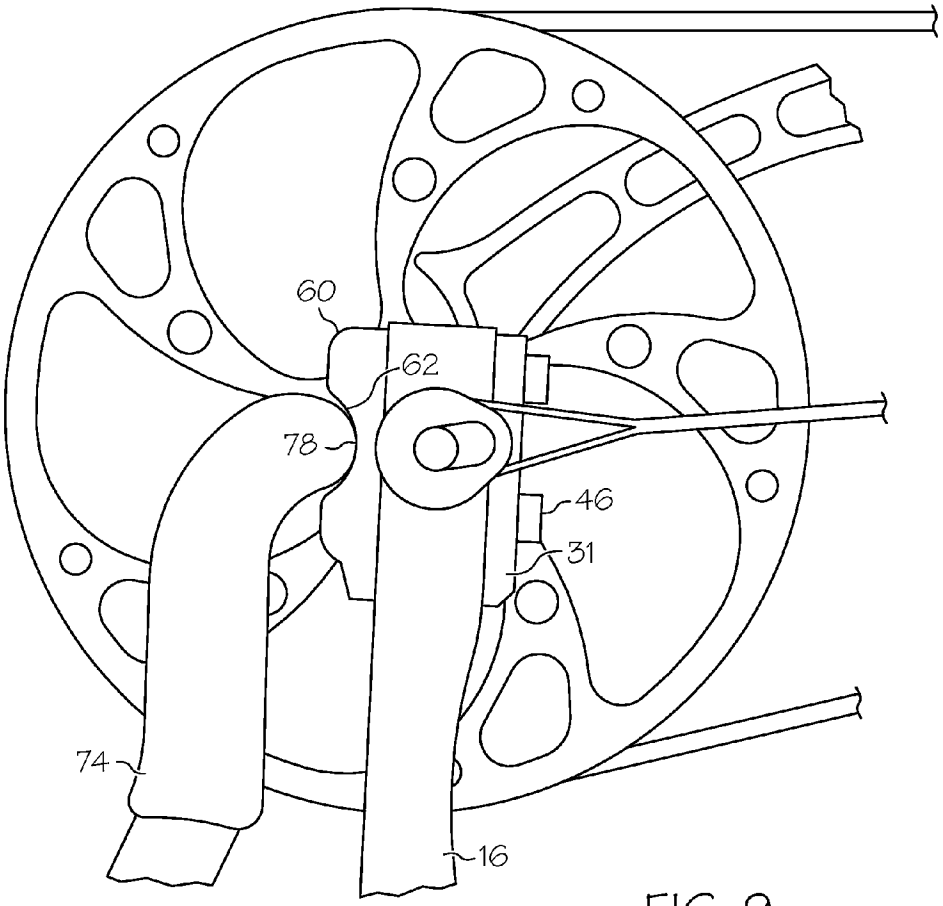
FIG. 9 shows a bow press engaging member abutting a bearing accessory of an archery bow.

FIG. 9 shows a side view of a bow press engaging member 74 engaging a bearing accessory 60. The bearing surface 62 comprises curvature in the lengthwise direction of the limb and is flat in the transverse direction of the limb. It can be seen that as the bow press moves to bias the limb, the limb will flex, effectively rotating the end of the limb 16. The shape of the bearing surface 62 remains normal to the surface 78 of the bow press engaging member 74 as the limb 16 moves and rotates, ensuring a secure engagement.

FIG. 9 shows an embodiment of a bearing accessory 60 comprising a target plate 38 wherein the target plate 38 is a compression member. The fasteners 46 extend through the target plate 38 but also abut the outer surface of the target plate 38. The fasteners 46 extend into the portion of the bearing accessory 60 that comprises the bearing surface 62 and engage the bearing accessory 60.

Figure 10:
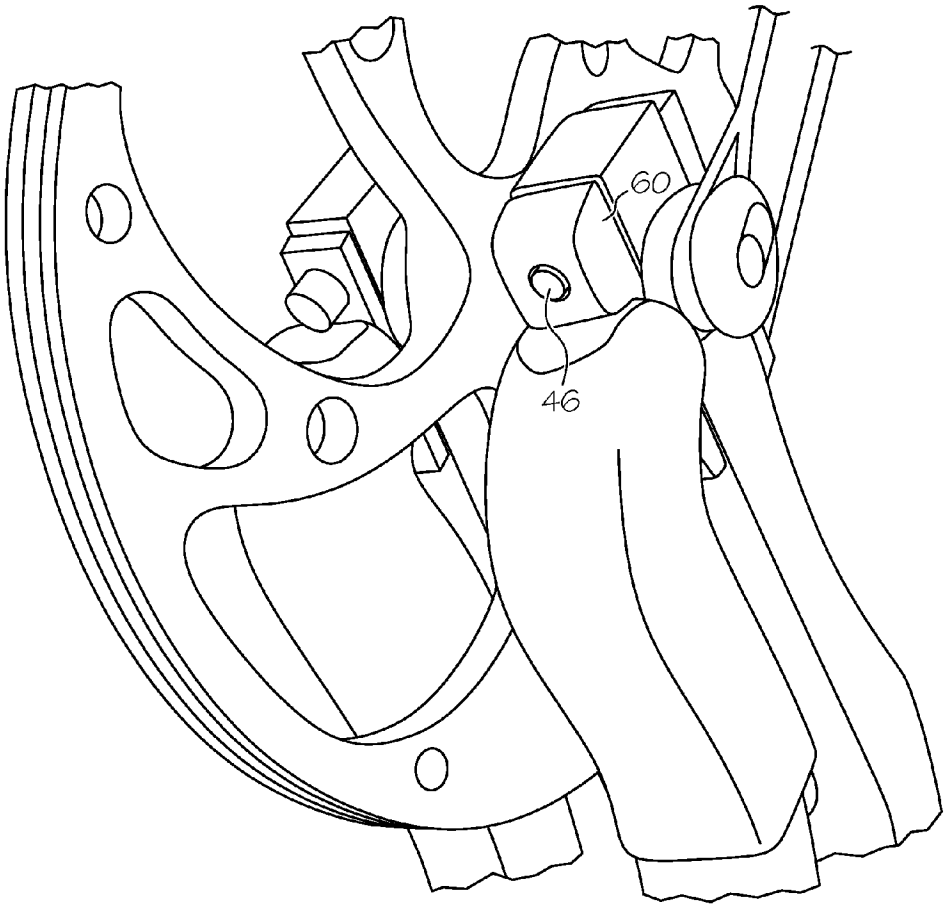
FIG. 10 shows a portion of a bow having an embodiment of a bearing accessory and an embodiment of bow press engaging members.

FIG. 10 shows an embodiment of a bearing accessory 60 wherein the heads of fasteners 46 are recessed in the bearing accessory 60.

In some embodiments, the target plate 38 comprises an archery bow accessory 66, such as a string suppressor as shown in FIGS. 5, 7 and 8.

In some embodiments, at least one bearing accessory 60 is included on each limb 16, 18. In some embodiments, the orientation of a bearing accessory 60 on the first limb 16 is a mirror image of the bearing accessory on the second limb 18.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser supporting a first limb and a second limb, each limb comprising a compression surface and a tension surface;

said first limb supporting an axle, said axle supporting a rotatable member;

at least one bearing accessory attached to the first limb, the bearing accessory comprising a raised portion extending outward beyond the tension surface of the first limb, said raised portion comprising curvature about an axis transverse to said first limb; and a target plate and a fastener, said fastener attaching said bearing accessory to said target plate.

2. The bow of claim 1, wherein said raised portion is flat in a direction parallel to said axis.

3. The bow of claim 1, wherein said curvature is convex with respect to the first limb.

4. The bow of claim 1, wherein a head of said fastener is recessed within said bearing accessory.

5. The bow of claim 1, comprising a plurality of bearing accessories.

6. The bow of claim 1, wherein said axle extends through said first limb.

7. The bow of claim 6, wherein said fastener extends through said first limb.

8. The archery bow of claim 1, the bearing accessory contacting the tension surface and the target plate contacting the compression surface.

9. An archery bow comprising:

a riser supporting a first limb and a second limb;

the first limb comprising a first end and a second end, the first end located closer to the riser than the second end, the first limb supporting a first axle, the first axle extending through the first limb, the first axle supporting a first rotatable member;

the second limb supporting a second axle, the second axle supporting a second rotatable member;

a bowstring and at least one power cable; and a fastener extending through said first limb, a longitudinal axis of the fastener oriented orthogonal to a longitudinal axis of the first axle, said fastener applying a compressive force to the first limb.

10. The archery bow of claim 9, wherein said fastener is located between the first axle and the second end of the first limb.

11. The archery bow of claim 9, further comprising a bearing accessory supported by the first limb, the bearing accessory contacting the fastener.

12. The archery bow of claim 9, the fastener comprising a first fastener, the bow further comprising a second fastener extending through the first limb, the first axle located between the first fastener and the second fastener.

13. The archery bow of claim 9, further comprising a target plate attached to the first limb by the fastener.

14. An archery bow comprising:

a riser supporting a first limb and a second limb;

the first limb comprising a first end and a second end, the first end located closer to the riser than the second end, the first limb supporting a first axle, the first axle extending through the first limb, the first axle supporting a first rotatable member;

the second limb supporting a second axle, the second axle supporting a second rotatable member;

a bowstring and at least one power cable; and a fastener extending through said first limb, the fastener located between the first axle and the second end of the first limb, said fastener applying a compressive force to the first limb.

15. The archery bow of claim 14, wherein a longitudinal axis of the fastener is oriented orthogonal to a longitudinal axis of the first axle.

16. The archery bow of claim 14, further comprising a bearing accessory supported by the first limb, the bearing accessory contacting the fastener.

17. The archery bow of claim 14, the fastener comprising a first fastener, the bow further comprising a second fastener extending through the first limb, the first axle located between the first fastener and the second fastener.

18. The archery bow of claim 14, further comprising a target plate attached to the first limb by the fastener.

* * * * *